United States Patent [19]

Stofen

[11] 4,311,439

[45] Jan. 19, 1982

[54] COMPRESSED AIR SYSTEM

[76] Inventor: Kenneth A. Stofen, 3642 Country La., Racine, Wis. 53405

[21] Appl. No.: 85,760

[22] Filed: Oct. 17, 1979

[51] Int. Cl.[3] ..... F04B 39/16

[52] U.S. Cl. ..... 417/313; 417/368; 62/298; 62/401; 55/269; 55/276; 55/385 R; 55/220

[58] Field of Search ..... 55/222, 257 HE, 269, 55/276, 385 R, DIG. 17, 359; 415/119, 121 R, 201, 219 R; 417/312, 313, 368; 181/211, DIG. 1; 62/401, 402, 298, DIG. 13

[56] References Cited

U.S. PATENT DOCUMENTS

| | | | |
|---|---|---|---|
| 885,697 | 6/1907 | Cousans | 415/119 |
| 893,756 | 7/1908 | Spencer | 417/313 |
| 2,027,809 | 1/1936 | Cornell, Jr. | 62/298 |
| 2,046,314 | 7/1936 | Benkly | 62/402 |
| 2,637,179 | 5/1953 | Gruss et al. | 62/298 |
| 2,971,507 | 2/1961 | Kiekhaefer | 417/312 |
| 3,736,074 | 5/1973 | Kilbane et al. | 55/276 |
| 3,766,749 | 10/1973 | Livesay | 62/298 |
| 3,789,954 | 2/1974 | Raleigh | 417/312 |
| 3,976,393 | 8/1976 | Larson | 415/219 R |
| 4,175,381 | 11/1979 | Scragg et al. | 60/641 |

FOREIGN PATENT DOCUMENTS

| | | | |
|---|---|---|---|
| 2628511 | 1/1977 | Fed. Rep. of Germany | 415/119 |
| 1328201 | 8/1973 | United Kingdom | 415/201 |

*Primary Examiner*—David L. Lacey
*Attorney, Agent, or Firm*—Peter N. Jansson

[57] ABSTRACT

An air compressor system of the type having fluid-treating components including a compressor and downstream coolers for hot fluids emanating from the compressor, characterized by a substantially airtight cabinet enclosing the fluid-treating components and including air outlets and an ambient air inlet, a device over the air inlet to clean incoming ambient air, and wherein the coolers are of the air-cooled type. In preferred embodiments, a device at the inlet, preferably a water-scrubbing air cleaner, cools incoming ambient air. The cabinet preferably includes a substantially vertical surrounding wall section and a removable cover engaged therewith. The cabinet wall section preferably includes at least two perimetrical portions removably interconnected to allow separation and thus to allow ready accessibility to fluid treating components. A highly preferred feature is a jack or other similar device for raising the cover for inspection and minor service.

10 Claims, 5 Drawing Figures

COMPRESSED AIR SYSTEM

This invention relates to the field of compressed air systems and in particular to fixed air compression installations such as the type generally used in factories for a variety of manufacturing and other industrial applications.

BACKGROUND OF THE INVENTION

The extent of compressed air generation in industry, particularly in factory-type installations, is very large and such compressed air generation uses a large amount of input energy and a large amount of water for cooling. For example, in the United States alone the annual power requirement for compressed air generation is estimated to be 13.8 billion horsepower hours, which is equivalent to about one billion gallons of fuel oil. And, an immense amount of cooling water is used (up to 200 gallons per day per horsepower), which represents a disposal problem which is costly both in sewer charges and heat energy wasted.

A large rise in internal energy during the air compression process is, of course, manifested in the high temperature of the outlet stream (both air and the oil such as in oil-flooded screw compressors) from the typical compressor. While the high temperature associated with adiabatic compression is totally undesirable, it is nevertheless an inescapable, inherent feature of the compression process; the increase in internal energy corresponds simply to the mechanical work input of the process.

The presence of waste heat in air compressor systems is not an academic one, since the removal of heat from the compressed air stream is necessary to lower the temperature and cause moisture to condense from the stream prior to ultimate use of the compressed air, and to cool the separated recirculating oil stream associated with oil-flooded compressor designs. High pressure air typically must be dry for the usual applications; therefore, cooling of the heated air stream coming from the compressor is required.

Water cooling of the hot compressed air stream and recirculating oil stream is the traditional, though not exclusive, practice. The use of ambient air for after-cooling of the compressed air stream and the recirculating oil stream is an attractive alternative to water-cooling, and it is in practice in certain installations where it is feasible. Generally, air-cooling equipment is more expensive than is water-cooling equipment, but the additional expense for equipment may be offest by not having to purchase water and not having to pay for its disposal.

A more serious drawback to air-cooling, however, is that ambient air is often dirty and leads to unacceptable fouling of heat exchange surfaces. This seems to be the principal factor which leads to the selection of water-cooled equipment for many applications. The large required quantities of dust-laden ambient air cannot be suitably and economically cleaned, so air-cooling is principally used only in those applications where relatively clean ambient air is available.

Besides the need for clean ambient air for air-cooling, it should be stressed that the quality of supply air (to be compressed) to compressors is also important. The need for high standards of compressed air purity for many uses is obvious, particularly for food processing, pharmaceutical manufacturing, and other highly controlled operations. In many such applications dirty compressed air is totally unacceptable.

Dirty intake air can also create undue maintenance expense. Some compressors, such as centrifugal and rotary vane compressors, have a low tolerance for particulate-laden air, and will malfunction early when exposed to it.

Another problem of the prior art relates to energy waste and efficiency of energy usage. Industries which require compressed air, like most other industries, are facing rapidly escalating energy costs. The typical water-cooled compressed air systems throw away much of the heat energy in the cooling water as it is drained into a sewer system or elsewhere. The alternative of air-cooling offers not only the benefit of eliminating water and disposal costs, but offers the possibility of using heated cooling air for direct heating of factory space. The recovery and use of waste heat, normally discarded with traditional water-cooling, is technically feasible and has been recognized in the art. The disclosed invention makes possible such recovery and use of waste heat even in relatively dirty environments where such has not previously been feasible.

Another problem in certain compressed air systems of the prior art has been the high noise levels often associated with compressor equipment. High noise levels are bothersome and dangerous to people working in the area and can even be harmful to property. One expensive solution to the problem has been to place compressor equipment in rooms separate from the work areas. This, however, is costly and reduces flexibility in factory space allocation.

Another more limited solution to the noise problem has been the use of compressor cabinets. Cabinets, however, have tended to limit accessibility to working components, and metal cabinets have been susceptible to corrosion. A need has existed for improved noise attenuation in compressed air systems.

BRIEF DESCRIPTION OF THE INVENTION

The invention is a compressed air system having an environmental barrier or envelope to contain the fluid-treating components and an associated air cleaning device over an air inlet to improve the quality of the compressed air and the exhaust air and to protect heat exchange surfaces. The invention includes a substantially airtight cabinet enclosing the fluid-treating components, such as the compressor and cooler. The cabinet includes air outlets and an ambient air inlet over which is sealed apparatus for cleaning incoming air. The cooling apparatus within the cabinet is of the air-cooled type.

In highly preferred embodiments, the cabinet includes a substantially vertical surrounding wall section for standing on a floor and a removable cover engaged with the wall section. The vertical wall section preferably includes two perimetrical portions removably interconnected to allow separation, such as by sliding them apart, for service of the fluid-testing components. A jack device preferably extends from the floor to the cover and serves to raise the cover from the wall section, typically for inspection and minor service of the fluid-treating components.

Certain highly preferred embodiments include means at the air inlet to cool incoming ambient air. A water-scrubbing air cleaner is preferably used to both cool and clean incoming ambient air. Such a scrubber device uses a tiny fraction of the amount of water required in the typical water-cooled after-coolers of the prior art.

In some preferred systems of this invention, a compressed air dryer downstream of the compressed air cooler and a compressed air reheater downstream of the dryer are included among the fluid-treating components within the airtight cabinet. Such additional components, which have been used in the prior art, provide compressed air of high quality.

The airtight cabinet of this invention is has a rigid outer protective shell of fiberglass or plastic and an inner layer of acoustically insulating material such as foam. This provides not only a sound barrier, but a corrosion-free environmental envelope for the fluid-treating components.

While proper compressor cabinets have been designed primarily to keep the compressor system quiet, the cabinet of this invention functions as a substantially airtight environmental barrier, and at the same time allows ready accessibility to internal components in varying degrees. This invention provides clean, cool, and quiet compressor system operation without sacrificing component accessibility.

OBJECTS OF THE INVENTION

A principal object of this invention is to provide a compressed air system overcoming the problems mentioned above.

Another object of this invention is to provide a compressed air system which can produce compressed air of improved quality.

Another object of this invention is to provide a compressed air system having improved energy efficiency.

Another object of this invention is to provide a compressed air system having superior operational characteristics even in areas having ambient air laden with particulates and other contaminants.

Yet another object of this invention is to provide an air compressor system which reduces or eliminates the use of cooling water and the problems and costs of disposing thereof.

Still another object of this invention is to provide a compressed air system facilitating recovery of waste heat for other purposes, such as space heating.

Another important object of this invention is to provide a compressed air system in which the heat exchange surfaces are protected from excessive accumulations of dirt which tend to reduce heat exchange efficiency.

Another object of this invention is to provide an air compressor system providing the above advantages and further having an acoustical barrier for excellent sound attenuation.

Still another object of this invention is to provide a system with the advantages described above and further allowing ready accessibility to system components for inspection, adjustment and repair.

These and other objects of the invention will become apparent from the following descriptions and from the drawings of preferred embodiments wherein:

DESCRIPTION OF PREFERRED EMBODIMENTS

Figure 2:
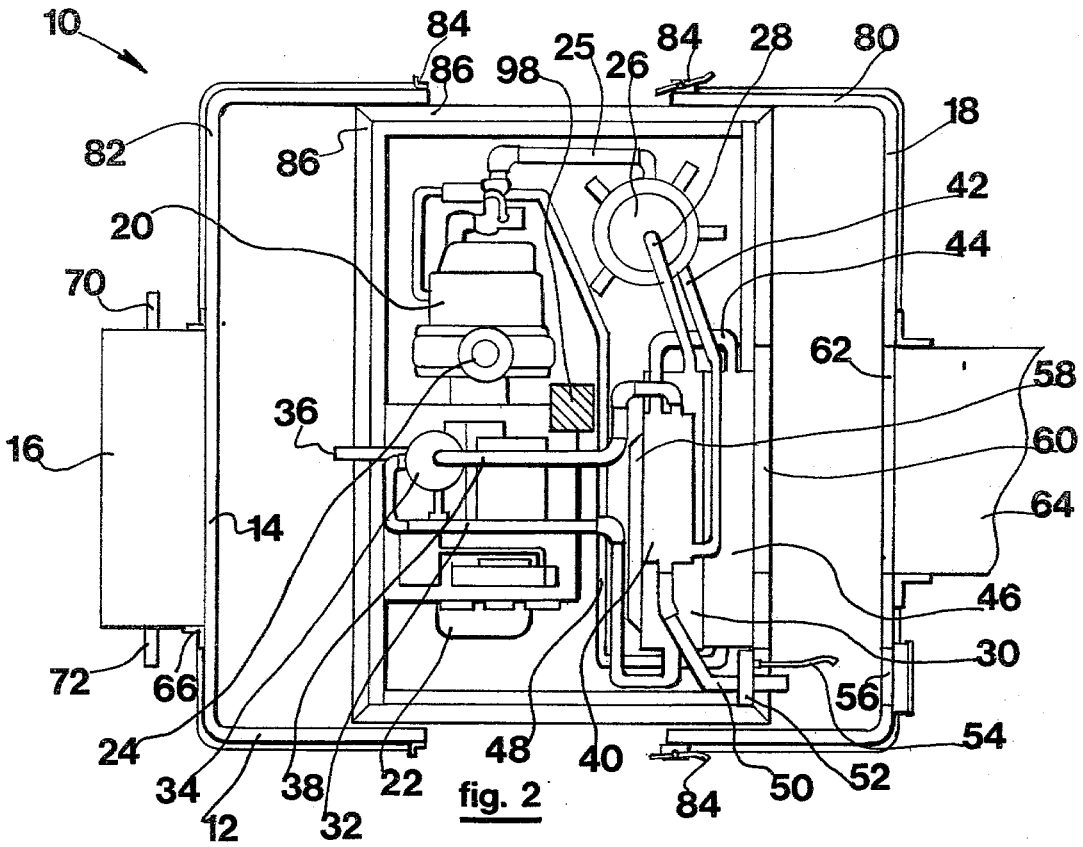
FIG. 2 is a top view of the apparatus of FIG. 1 with the cover thereof removed.

The drawings illustrate an air compressor system 10 which is a preferred embodiment of this invention. Air compressor system 10 includes a number of fluid-treating components illustrated best in FIG. 2, and a substantially airtight cabinet 12 enclosing the fluid-treating components.

Cabinet 12 includes an ambient air inlet 14 through which all or virtually all the air used in the system must pass, whether it be used for cooling the compressor equipment or whether it is the air to be compressed in the system. Air passing through ambient air inlet 14 has been treated by a water-scrubbing air cleaner 16 which is attached to one side of the vertical surrounding wall section 18 and sealed over ambient air inlet 14. Cabinet 12 also includes air outlet means, that is, a panel aperture 56 which accommodates a compressed air exit line 50, and a fan outlet aperture 62, which accommodates the outflow of air used for cooling.

FIG. 2 illustrates the operation of the fluid-treating components within cabinet 12. All of the components inside cabinet 12 are known in the art. An oil flooded screw compressor 20 includes an electric driving motor 22. Compressor 20 has an air intake 24 which receives air from within cabinet 12 and compresses it in known fashion. Screw compressor 20 pumps compressed air and oil to an oil separator 26 via line 25. Separator 26 creates an oil stream and a compressed air stream.

An air line 28 from separator 26 carries compressed air to an aftercooler 30 where the compressed air, which is hot after compression, is reduced in temperature. After cooling, the compressed air moves through air line 32 to an air dryer 34, which removes water which has condensed from the compressed air stream upon cooling. Such liquid is removed from the air stream through condensate drain 36 and is directed into the water flow system of water-scrubbing air cleaner, which will be described hereinafter.

Air line 38 transmits the cooled and dried compressed air to a reheater 40. Reheater 40 also receives hot oil transmitted to reheater 40 via oil line 42. Reheater 40 provides an exchange of heat, the compressed air being heated to a temperature desirable for use and the oil being cooled toward the temperature desired for reuse in compressor 20. In reheater 40, the air gains back the heat that was given up in aftercooler 30 but now has substantially reduced relative humidity. The oil which has been cooled in reheater 40 is transmitted by oil line 44 to an oil cooler 46 where its temperature is reduced to a level appropriate for reuse of the oil in screw compressor 20. Oil line 48 transmits the cooled oil back to compressor 20.

Aftercooler 30 and oil cooler 46 are of the air-cooled type. Aftercooler 30 and oil cooler 46 utilize clean air from within cabinet 12 for cooling purposes. The air contacting heat exchange surfaces of aftercooler 30 and oil cooler 46 is substantially free of dust and dirt, which could reduce cooling efficiency and cause other operational problems, by virtue of the fact that all air coming in contact therewith has been cleaned by water-scrubbing air cleaner 16. Air-cooled aftercooler 30 and air-cooled oil cooler 46 are of known type. Operating in the clean environment of cabinet 12, however, their operation is unusually trouble free and efficient.

Figure 1:
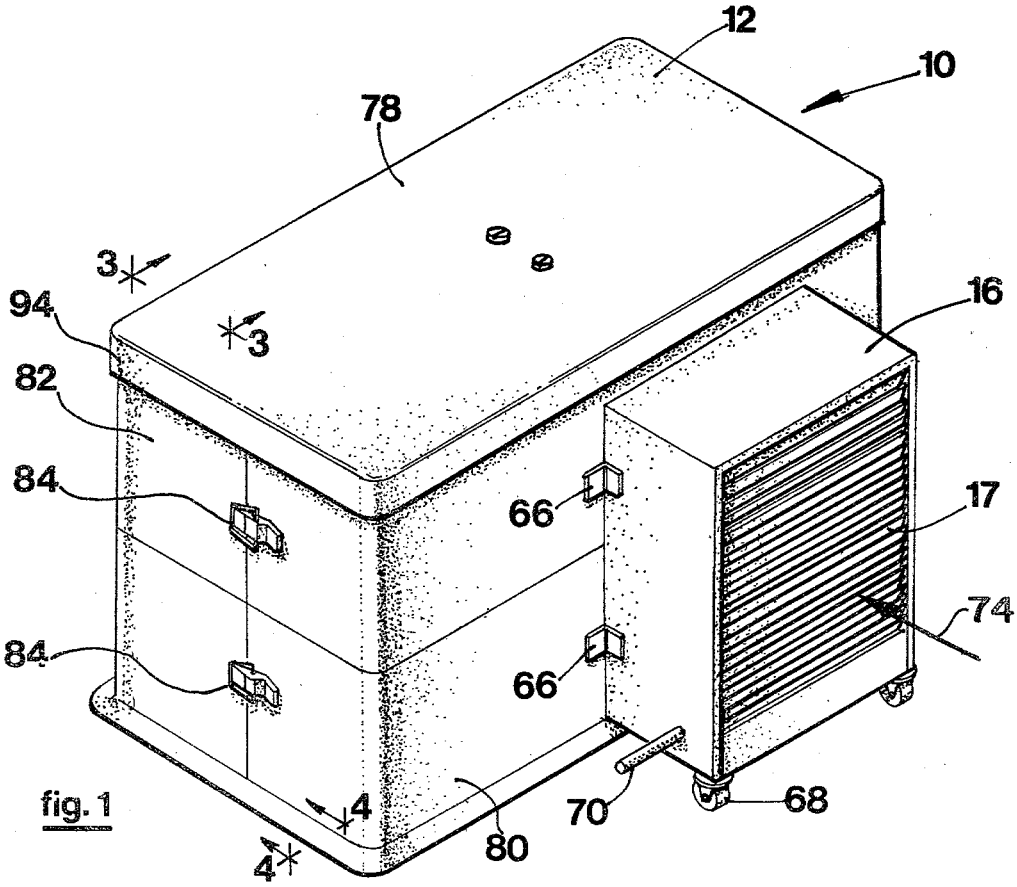
FIG. 1 is a perspective view of a preferred air compressor system according to this invention.

Reheated and dried air exits from reheater 40 via exit line 50 which passes through service panel 52. Also attached at service panel 52 is a power input line 54. Service panel 52 is exposed through vertical wall section 18 of cabinet 12 at panel aperture 56 which sealingly engages with service panel 52 when cabinet 12 is in its completely assembled condition, as shown in FIG. 1.

A fan 58, located adjacent to aftercooler 30 and oil cooler 46 directs air from within cabinet 12 over aftercooler 30 and oil cooler 46, as mentioned above. A fan outlet 60 is located adjacent to service panel 52 and is designed for sealing engagement with a cooling air outlet 62 defined in vertical wall section 18 of cabinet 12. Exhaust air driven through fan outlet 60 and cooling air outlet 62 in cabinet 12 is received in ductwork 64. Ductwork 64 can be directed to either outside the building in which this system is located or can be used for heating of the building or other useful purposes. Such air is particularly suited for space heating because of the cleaning which was earlier effected by water-scrubbing air cleaner 16 as the air entered cabinet 12.

Water-scrubbing air cleaner 16 is mounted to vertical wall section 18 of cabinet 12 by connectors 66 and its weight is supported on the floor through coasters 68. Water-scrubbing air cleaner 16 includes a water inlet 70 and a water outlet 72. Water-scrubbing air cleaner 16 is of known type. Dust and dirt and other particulates entering air cleaner 16 through its large air inlet 17, as illustrated by arrow 74, are captured within a water stream within air cleaner 16 and removed in the water through water outlet 72. The water from condensate drain 36 is also removed through water outlet 72.

The volume of water required by a water-scrubbing air cleaner is insignificant when compared to the high volume of water needed when water 35 is used for cooling of the compressed air stream and the hot oil stream emanating from an air compressor. Therefore, the water and sewer costs connected with water-scrubbing air cleaner 16 are negligible in comparison with the costs associated with the water-coolng methods avoided by the instant invention.

The water in water-scrubbing air cleaner 16 provides a further significant advantage, particularly in very hot working environments. The water in air cleaner 16 provides initial cooling of intake air by direct contact therewith. Such cooling is enhanced by virtue of evaporation which occurs within the device. The cooled air thus entering cabinet 12 is more efficiently compressed by air compressor 20 and is more useful in the cooling operations of aftercooler 30 and oil cooler 46. Thus, water-scrubbing air cleaner 16 beneficially functions as both an intake air cleaning means and as an intake air cooling means.

As indicated, cabinet 12 includes substantially vertical surrounding wall section 18 which rests on the floor 76 and further includes a removable cover 78 engaged with vertical wall section 18 when the cabinet is closed as illustrated in FIG. 1. Vertical wall section 18 includes two perimetrical portions 80 and 82 which are removably interconnected by clasps 84 on opposite sides of cabinet 12. When wall portions 80 and 82 are connected, clasps 84 hold them together in substantially airtight fashion along their common edges.

Figure 4:
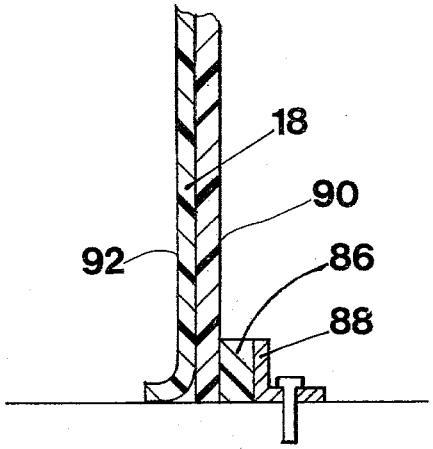
FIG. 4 is another enlarged, fragmentary sectional view, taken along section 4—4 as indicated in FIG. 1.

The airtight seal of vertical wall section 18 to floor 76 is illustrated in FIG. 4. A flexible seal 86 is secured to floor 76 through an angle iron 88. Flexible seal 86 is attached to floor 76 at a predetermined location chosen to accommodate vertical wall section 18.

Figure 3:
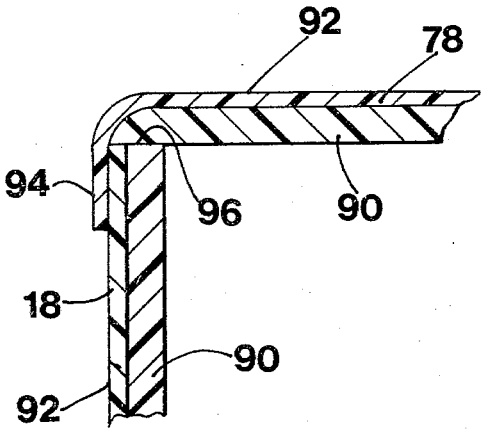
FIG. 3 is an enlarged, fragmentary sectional view taken along section 3—3 as indicated in FIG. 1.

The connection of cover 78 and vertical wall section 18 is illustrated in FIG. 3. Cover 78 and vertical wall section 18 are laminated materials including a sound-deadening inner layer 90 in contact with a rigid outer shell 92. Cover 78 includes a lip portion 94 which slides over vertical wall section 18 and allows the upper edge 96 of vertical wall section 18 to come into sealing engagement with inner layer 90 of cover 78, providing a substantially airtight engagement of cover 78 with vertical wall section 18.

Figure 5:
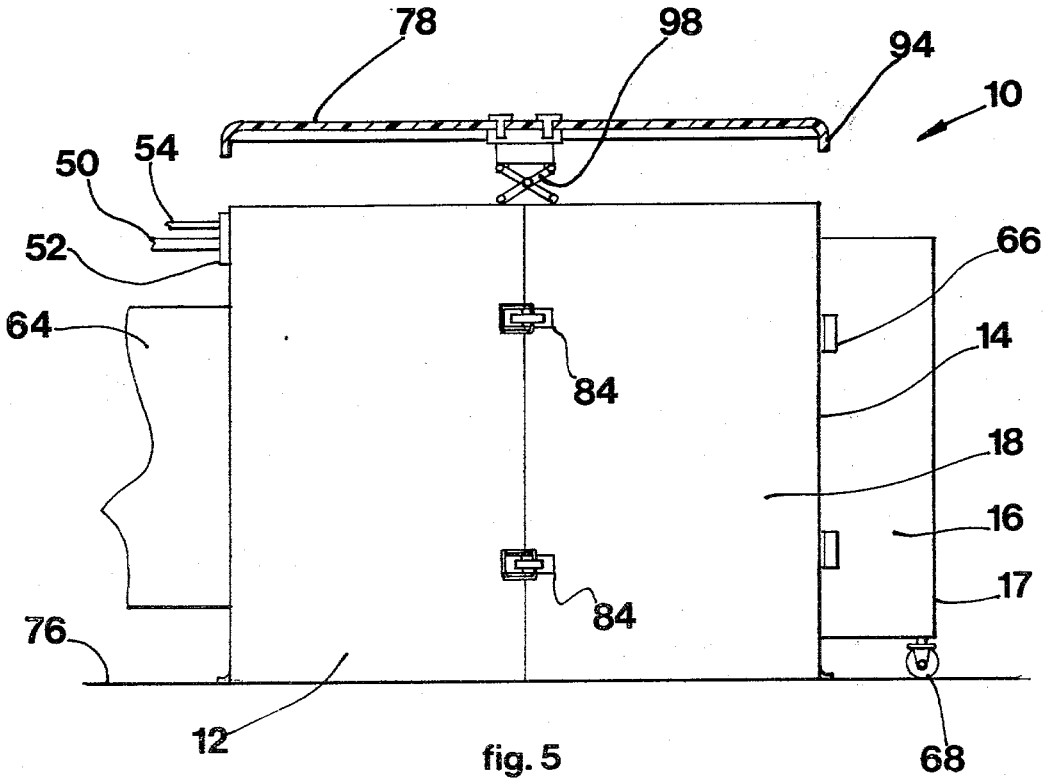
FIG. 5 is a left side elevation of the apparatus of FIG. 1, illustrating the apparatus with its cover in an elevated position.

FIGS. 2 and 5 illustrate a jack 98 which is located about in the middle of the system and extends from floor 76 to cover 78. Jack 98 may be used to raise cover 78 for inspection and minor service of the fluid-treating components. Jack 98 is remotely controllable by controls (not shown) on service panel 52. This feature of the invention is a very convenient means of accommodating minor service and equipment checking. If more significant service or component replacement is needed, one or both of wall portions 80 and 82 may be conveniently moved, with cover 78 raised, from their normal closed positions to make the fluid-treating components of this air compressor system readily accessible. Cover 78 may be detached from the jack and entirely removed from vertical wall section 18 as required for major maintenance. This cabinet allows both substantially airtight enclosure and protection of the fluid-treating components during operation and easy accessibility in varying degrees for service.

No separate framework or supporting members are required to support vertical wall section 18 or cover 78. Other than flexible seal 86 on the floor, no structure remains when wall section 18 and cover 78 are removed. The cabinet is free-standing in nature.

Vertical wall section 18 and cover 78 are preferably made of laminated materials including a rigid outer layer such as high density polyethylene, polypropylene, or other rigid plastics. Fiberglass is another highly preferred material for rigid outer shell 92. Inner layer 90 may be laminated with outer shell 92 in the forming process or by subsequent gluing or other connection methods. Inner layer 90 may be a foamed plastic material such as various polyurethanes or may be other sound-deadening materials. Acceptable materials would be apparent to those skilled in the art.

Air coming into cabinet 12 could be cleaned using dry filters of known type or the like. A water-scrubbing air cleaner, however, is highly preferred.

As previously indicated, water-scrubbing air cleaner 16 and the fluid-treating components inside cabinet 12 are all of a type known to those skilled in the art. Anyone familiar with this invention could readily select components suitable to build a system in accordance with this invention for the particular application which must be satisfied.

While in the foregoing specification, this invention has been described in relation to certain preferred embodiments and many details have been set forth for purpose of illustration, it will be apparent to those skilled in the art that the invention is susceptible to additional embodiments and that certain of the details described herein can be varied considerably without departing from the basic principles of the invention.

I claim:

1. In an air compressor system of the type having fluid-treating components including a compressor, conduit means for transmitting hot compressed fluids from the compressor, and means for cooling such hot fluids, the improvement comprising:

a substantially airtight cabinet enclosing the fluid-treating components and having ambient air inlet means, a compressed air outlet, and a cooling air outlet;

means sealed over the inlet means to clean incoming ambient air whereby substantially all air within the cabinet has been cleaned thereby;

said compressor having an air intake within the cabinet whereby air drawn into said compressor is cleaned air received from within the cabinet;

said cooling means including heat exchange surfaces connected to said conduit means; and a fan positioned and arranged to move cleaned air from within the cabinet over said heat exchange surfaces as a cooling fluid.

2. The system of claim 1 wherein the cabinet includes a substantially vertical surrounding wall section for standing on a floor and a removable cover engaged with the wall section.

3. The system of claim 2 wherein the cabinet wall section includes at least two perimetrical portions removably interconnected whereby to allow removal for service of the fluid-treating components.

4. The system of claim 1, 2, or 3 wherein said air cleaning means is a water-scrubbing air cleaner, whereby ambient air entering the cabinet may be cooled as well as cleaned thereby.

5. The system of claim 1, 2, or 3 wherein said conduit means includes a compressed air line with said heat exchange surfaces connected thereto and wherein the fluid-treating components further include a compressed air dryer downstream of said heat exchange surfaces along said compressed air line and a compressed air reheater downstream of the dryer along said compressed air line.

6. The system of claim 5 wherein said air cleaning means is a water-scrubbing air cleaner, whereby ambient air entering the cabinet may be cooled as well as cleaned thereby.

7. In an air compressor system of the type having fluid-treating components including a compressor, conduit means for transmitting hot compressed fluids from the compressor, and means for cooling such hot fluids, the improvement comprising:

a substantially airtight cabinet enclosing the fluid-treating components and having an ambient air inlet, a compressed air outlet, and a cooling air outlet, said cabinet including a substantially vertical surrounding wall section for standing on a floor and a removable cover engaged with the wall section;

means connected to the cover for raising the cover from the wall section for service of the fluid-treating components;

means sealed over the inlet to clean incoming ambient air;

said cooling means including heat exchange surfaces connected to said conduit means; and a fan positioned and arranged to move air from within the cabinet over said heat exchange surfaces.

8. The system of claim 1, 2, 3, or 7 wherein the cabinet is of a rigid plastic laminated sheet including an outer shell and an inner layer of acoustically insulating material.

9. The system of claim 8 wherein said air cleaning means is a water-scrubbing air cleaner, whereby ambient air entering the cabinet may be cooled as well as cleaned thereby.

10. The system of claim 7 wherein the cabinet wall section includes at least two perimetrical portions removably interconnected whereby to allow removal for service of the fluid-treating components.

* * * * *

UNITED STATES PATENT AND TRADEMARK OFFICE

CERTIFICATE OF CORRECTION

PATENT NO. : 4,311,439

DATED : January 19, 1982

INVENTOR(S) : Kenneth A. Stofen

It is certified that error appears in the above-identified patent and that said Letters Patent is hereby corrected as shown below:

Column 3, line 8, omit the word "is".

Column 3, line 14, change "proper" to --prior--.

Column 4, line 38, after the word "After" insert --such--.

Column 7, line 17, a new subparagraph should start after the word "and" and beginning with the words "a fan".

Column 8, line 25. a new subparagraph should start after the word "and " and beginning with the words "a fan".

Signed and Sealed this

Twenty-ninth Day of December, 1992

*Attest:*

DOUGLAS B. COMER

*Attesting Officer*

*Acting Commissioner of Patents and Trademarks*